US005666396A

United States Patent [19]

Linders et al.

[11] Patent Number: 5,666,396

[45] Date of Patent: Sep. 9, 1997

[54] X-RAY EXAMINATION APPARATUS COMPRISING A FILTER

[75] Inventors: Petrus W. J. Linders; Christianus G.L.M. Nederpelt, both of Eindhoven, Netherlands

[73] Assignee: U.S. Philips Corporation, New York, N.Y.

[21] Appl. No.: 679,036

[22] Filed: Jul. 12, 1996

[30] Foreign Application Priority Data

Jul. 13, 1995 [EP] European Pat. Off. ..... 95201925

[51] Int. Cl.[6] ..... G21K 3/00

[52] U.S. Cl. ..... 378/156; 378/158

[58] Field of Search ..... 378/156, 157, 378/158, 159

[56] References Cited

U.S. PATENT DOCUMENTS 4,701,021 10/1987 Le Pesant et al. ..... 359/228

FOREIGN PATENT DOCUMENTS 2599886 12/1987 France .

2601493 1/1988 France ..... 378/159

9613040 10/1995 WIPO .

*Primary Examiner*—David P. Porta

*Attorney, Agent, or Firm*—Jack D. Slobod

[57] ABSTRACT

An X-ray examination apparatus in accordance with the invention includes a filter (4) for limiting the dynamic range of an X-ray image which is formed on an X-ray detector (4) by irradiation of an object (3), for example a patient to be examined, by means of X-rays (15). The filter (4) includes filter elements (5), being capillary tubes (5), one end of which communicates with an X-ray absorbing liquid. The adhesion of the X-ray absorbing liquid to the inner side of the capillary tubes is adjustable by means of an electric voltage which can be applied to an electrically conductive layer (36) provided on the inner side of the capillary tubes (5). The filling of the capillary tubes (5) with the X-ray absorbing liquid is adjusted on the basis of the period of time during which the electric voltage is applied. This period of time can be subdivided into a number of fractions and individual rows of capillary tubes are then filled with the X-ray absorbing liquid partly in parallel.

6 Claims, 4 Drawing Sheets

X-RAY EXAMINATION APPARATUS COMPRISING A FILTER

BACKGROUND OF THE INVENTION

1. Field of the Invention

The invention relates to an X-ray examination apparatus, including an X-ray source, an X-ray detector and an X-ray filter which is arranged between the X-ray source and the X-ray detector and includes a plurality of filter elements having an X-ray absorptivity which can be adjusted by controlling a quantity of X-ray absorbing liquid within the individual filter elements. The invention also relates to a method of setting an X-ray examination apparatus, involving the adjustment of the X-ray absorptivity of filter elements of an X-ray filter by controlling a quantity of X-ray absorbing liquid within the individual filter elements.

2. Description of the Related Art

An X-ray examination apparatus and a method of this kind are known from French Patent Application FR 2 599 886.

The known X-ray examination apparatus comprises a filter for limiting the dynamic range of an X-ray image, being the interval between the extremes of the brightness values. An X-ray image is formed on the X-ray detector by arranging an object, for example a patient to be examined, between the X-ray source and the X-ray detector and by irradiating said object by means of X-rays emitted by the X-ray source. If no steps are taken, the dynamic range of the X-ray image may be large. On the one hand, for some parts of the object, for example lung tissue, the X-ray transmittance is high whereas other parts of the object, for example bone tissue, can hardly be penetrated by X-rays. If no further steps are taken, therefore, an X-ray image is obtained with a large dynamic range whereas, for example, medically relevant information in the X-ray image is contained in brightness variations in a much smaller dynamic range; because it is not very possible to make small details of low contrast nimbly visible in a rendition of such an X-ray image, the image is not very well suitable for making a diagnosis. If, using an image-intensifier pick-up chain, the X-ray image is converted into an optical image which is picked up by means of video camera, the dynamic range of the optical image could be larger than the range of brightness values that can be handled by the video camera without causing disturbances in the electronic image signal.

In order to limit the dynamic range of the X-ray image the known X-ray examination apparatus comprises a filter with filter elements provided with a bundle of parallel capillary tubes, each of which is connected, via a valve, to a reservoir containing an X-ray absorbing liquid which suitably wets the inner walls of the capillary tubes. In order to fill a capillary tube with the X-ray absorbing liquid, the valve of the relevant capillary tube is opened, after which the capillary tube is filled with the X-ray absorbing liquid by the capillary effect. Such a filled capillary tube has a high absorptivity for X-rays passing through such a filled capillary tube in a direction approximately parallel to its longitudinal direction. The valves are controlled so as to ensure that the amount of X-ray absorbing liquid in the capillary tubes is adjusted in such a manner that in parts of the X-ray beam which pass through object parts of low absorptivity filter elements are adjusted to a high X-ray absorptivity and that filter elements in parts of the X-ray beam which pass through object parts of high absorptivity or are intercepted by a lead shutter are adjusted to a low X-ray absorptivity.

In order to change the setting of the filter of the known X-ray examination apparatus it is necessary to empty filled capillary tubes first. Therefore, use is made of a paramagnetic X-ray absorbing liquid which is removed from the capillary tubes by application of a magnetic field. After all capillary tubes have been emptied, the filter is adjusted anew by de-activation of the magnetic field and by subsequently opening valves of capillary tubes which are filled with the X-ray absorbing liquid so as to adjust these tubes to a high X-ray absorptivity in the new filter setting. Consequently, it is not very possible to change the setting of the known filter within a brief period of time, for example one second. Therefore, the known X-ray apparatus is not suitable for the formation of successive X-ray images at a high image rate where the setting of the filter is changed between the formation of successive X-ray images.

Control of the quantity of X-ray absorbing liquid in the capillary tubes necessitates accurate control of the period of time during which the valves are open; however, because the mechanical driving of the valves involves, for example inertia and play, fast and accurate control of the quantity of X-ray absorbing liquid in the capillary tubes is not very well possible.

An object of the invention is to provide an X-ray examination apparatus which comprises an X-ray filter which can be adjusted more quickly and more accurately than the known filter.

To this end, an X-ray examination apparatus in accordance with the invention is characterized in that it comprises an adjusting unit for applying an electric voltage to the individual filter elements, which adjusting unit comprises a timer unit for controlling the period of time during which the electric voltage is applied to the filter elements.

The relative quantity of liquid is to be understood to mean herein the quantity of liquid in such a filter element compared to the quantity of liquid in the relevant filter element when it is completely filled with the liquid. The electric voltage applied to a filter element influences the adhesion of the X-ray absorbing liquid to the inner side of the relevant filter element and this adhesion determines the degree of filling of the filter element with the X-ray absorbing liquid. The relative quantity of X-ray absorbing liquid in individual filter elements is controlled on the basis of the electric voltages applied to individual filter elements. As the electric voltage is applied to such a filter element for a longer period of time, the relative quantity of X-ray absorbing liquid in the relevant filter element increases and hence the X-ray absorptivity of said filter element also increases. Depending on the period of time during which the electric voltage is applied, electric current is applied to a filter element which is thus electrically charged. The relative quantity of liquid in the relevant filter element, and hence the X-ray absorptivity, is dependent on the electric charge on the relevant filter element. Because the period of time during which the electric voltage is applied to the individual filter elements can be accurately controlled, the relative quantity of X-ray absorbing liquid can be accurately controlled and hence also the X-ray absorptivity of the individual filter elements. In order to change the setting of the X-ray absorptivity of the filter elements it is not necessary to empty the filter elements first, so that changing the setting of the filter requires a short time only, such as one or a few seconds.

A preferred embodiment of an X-ray examination apparatus in accordance with the invention is characterized in that the timer unit is arranged to apply the electric voltage to individual groups of filter elements during a continuous period of said controllable duration.

As soon as the electric voltage is applied to a filter element, the X-ray absorbing liquid adheres to the inner side of said filter element so that the latter is fired with the X-ray absorbing liquid; filling continues, for as long as the electric voltage is applied, until, if desired, the filter element has been completely filled. As soon as the electric voltage is switched off, the adhesion no longer increases so that the filter element is not filled further. The filter setting is realized by a simple switching procedure by applying the electric voltage to individual groups of filter elements for a continuous period of time of desired duration. If differences are required between the X-ray absorptivities of individual, single filter elements, such a group of filter elements may also comprise a single filter element. Another simple switching procedure concerns the application of the electric voltage to groups of filter elements within a continuous period of time in which the electric voltages are applied to individual filter elements wig such a group during periods of time of different lengths. In an X-ray filter comprising a matrix of filter elements such a group is formed, for example by a row or column of filter elements. In this example filter elements are driven per row or per column within individual, continuous periods.

A further preferred embodiment of an X-ray examination apparatus in accordance with the invention is characterized in that the timer unit is arranged to apply the electric voltage alternately to individual groups of filter elements, repeatedly during separate sub-periods.

The flowing of X-ray absorbing liquid into the filter elements requires electric work which is supplied by the electric charging of a capacitor formed by the filter element whose capacitance varies as a function of the relative quantity of X-ray absorbing liquid in the relevant filter element. Because of the inertia of the flowing in of the X-ray absorbing liquid, the electric work cannot be performed within an arbitrarily short period of time. By delivering the charge to groups of individual filter elements in a number of time discrete fractions, individual groups, for example rows or columns, are at least partly simultaneously filled with the X-ray absorbing liquid. Because individual groups are filled with X-ray absorbing liquid in parallel instead of serially, individual filter elements are effectively given more time so as to be filled with the X-ray absorbing liquid, but the total adjusting time of the filter is not prolonged. According to this method of setting the filter, the filter elements are more or less simultaneously adjusted so that the rendition of the X-ray image can be suitably used for diagnostic purposes also during the setting of the filter.

These and other aspects of the invention will be apparent from and elucidated with reference to the embodiments described hereinafter.

DETAILED DESCRIPTION OF THE PREFERRED EMBODIMENTS

Figure 1:
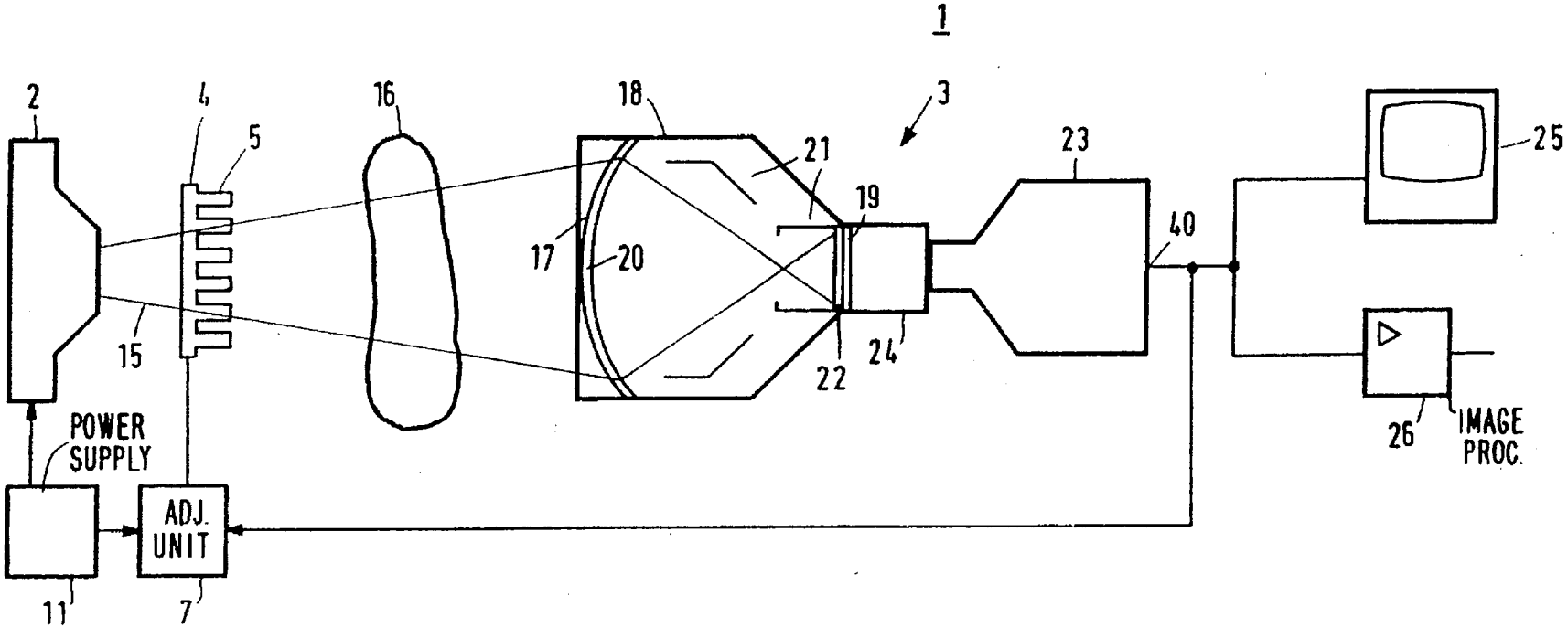
FIG. 1 is a diagrammatic representation of an X-ray examination apparatus in accordance with the invention.

FIG. 1 shows diagrammatically an X-ray examination apparatus 1 in accordance with the invention. The X-ray source 2 emits an X-ray beam 15 for irradiating an object 16. Due to differences in X-ray absorption within the object 16, for example a patient to be radiologically examined, an X-ray image is formed on an X-ray sensitive surface 17 of the X-ray detector 3, which is arranged opposite the X-ray source. The X-ray detector 3 of the present embodiment is formed by an image intensifier pick-up chain which includes an X-ray image intensifier 18 for converting the X-ray image into an optical image on an exit window 19 and a video camera 23 for picking up the optical image. The entrance screen 20 acts as the X-ray sensitive surface of the X-ray image intensifier which converts X-rays into an electron beam which is imaged on the exit window by means of an electron optical system 21. The incident electrons generate the optical image on a phosphor layer 22 of the exit window 19. The video camera 23 is coupled to the X-ray image intensifier 18 by way of an optical coupling 24, for example a lens system or a fiber-optical coupling. The video camera 23 extracts an electronic image signal from the optical image, which signal is applied to a monitor 25 for the display of the image information in the X-ray image. The electronic image signal may also be applied to an image processing unit 26 for further processing.

Between the X-ray source 2 and the object 16 there is arranged the X-ray filter 4 for local attenuation of the X-ray beam. The X-ray filter 4 comprises a large number of filter elements 5 in the form of capillary tubes whose X-ray absorptivity can be adjusted by application of an electric voltage, referred to hereinafter as adjusting voltage, to the inner side of the capillary tubes by means of the adjusting unit 7. The adhesion of the X-ray absorbing liquid to the inner side of the capillary tubes can be adjusted by means of an electric voltage to be applied to an electrically conductive layer (36) on the inner side of the capillary tubes (5). One end of the capillary tubes communicates with a reservoir 30 for an X-ray absorbing liquid. The capillary tubes are fried with a given quantity of X-ray absorbing liquid as a function of the electric voltage applied to the individual tubes. Because the capillary tubes extend approximately parallel to the X-ray beam, the X-ray absorptivity of the individual capillary tubes is dependent on the relative quantity of X-ray absorbing liquid in such a capillary tube. The electric adjusting voltage applied to the individual filter elements is adjusted by means of the adjusting unit 7, for example on the basis of brightness values in the X-ray image and/or the setting of the X-ray source 2; to this end, the adjusting unit is coupled to the output terminal 10 of the video camera and to the power supply 11 of the X-ray source 2. The construction of an X-ray filter 4 of this kind and the composition of the X-ray absorbing liquid are described in detail in the International Patent Application No. 1B95/00874).

Figure 2:
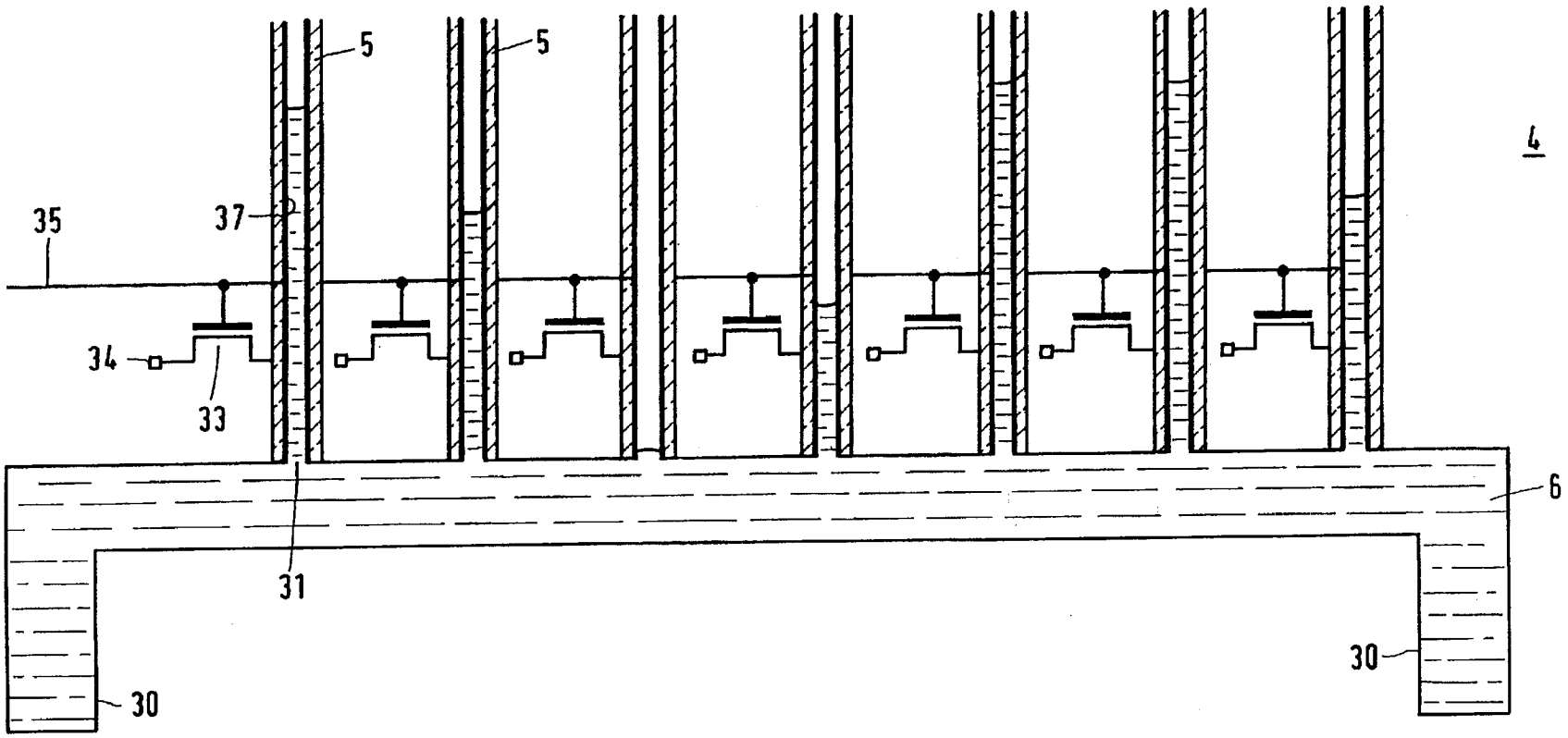
FIG. 2 is a side elevation of an X-ray filter of the X-ray examination apparatus shown in FIG. 1.

FIG. 2 is a side elevation of an X-ray filter 4 of the X-ray examination apparatus of FIG. 1. The Figure shows seven capillary tubes by way of example, but a practical embodiment of an X-ray filter 4 of an X-ray examination apparatus in accordance with the invention may comprise a large number of capillary tubes, for example 40,000 tubes in a 200×200 matrix arrangement. Each of the capillary tubes 5 communicates with the X-ray absorbing liquid 6 via an end 31. The inner side of the capillary tubes is covered by an electrically conductive layer 37, for example of gold or platinum which layer 37 is coupled to a voltage line 34 via a switching element 33. For application of the electric adjusting voltage to an electrically conductive layer 37 of a capillary tube, the relevant switching element 33 is closed while the voltage line 34 which thus electrically contacts the capillary tube has been adjusted to the desired electric adjusting voltage. The switching elements are driven by a control line 35. When brief voltage pulses having a length of a few tens of microseconds are used, adjusting voltages in a range of from 0 V to 400 V can be used. In this voltage range switches in the form of α-Si thin-film transistors can be used. Preferably, an adjusting voltage in the range of from 30 V to 100 V is used. Because the voltage pulses are so brief, the application of the adjusting voltage does not cause any, or hardly any, electrolysis of the lead salt solution used as the X-ray absorbing liquid. The X-ray absorptivity of the individual capillary tubes can be controlled on the basis of the period of time during which the electric adjusting voltage is applied to the capillary tubes. Each of the capillary tubes, notably the conductive layer 37 and the X-ray absorbing liquid in the capillary tube, constitutes a capacitor. During the filling of such a capillary tube with the X-ray absorbing liquid, the capacitance of said capacitor varies as a function of the level of the liquid in the capillary tube or, in other words, as a function of the relative filling of said capillary tube. The charging of the capacitor produces electric energy for filling the capillary tube with the X-ray absorbing liquid. The longer the electric adjusting voltage remains applied, the further the capacitor is charged and the more the tube is filled with the X-ray absorbing liquid. On the electrically conductive layer there is preferably provided a dielectric layer of a thickness which suffices to ensure that the electric capacitance of the capillary tubes remains low enough to enable fast response to the application of the electric voltage. In order to ensure that the contact angle between the X-ray absorbing liquid and the inner side of the capillary tubes varies, as a function of the applied electric voltage, in a range of values which includes the contact angle value 90°, for example a coating layer having suitable hydrophilic/hydrophobic properties is provided on the dielectric layer. Use is preferably made of metal capillary tubes whose inner side is covered by successively the dielectric layer and the coating layer. The electric voltage can then be applied to the metal of the tubes. The manufacture of an embodiment of this kind is easier than providing glass capillary tubes with a metal coating. When a teflon layer is used as the dielectric layer covering the inner side of a metal tube, a separate coating layer can be dispensed with.

Figure 3:
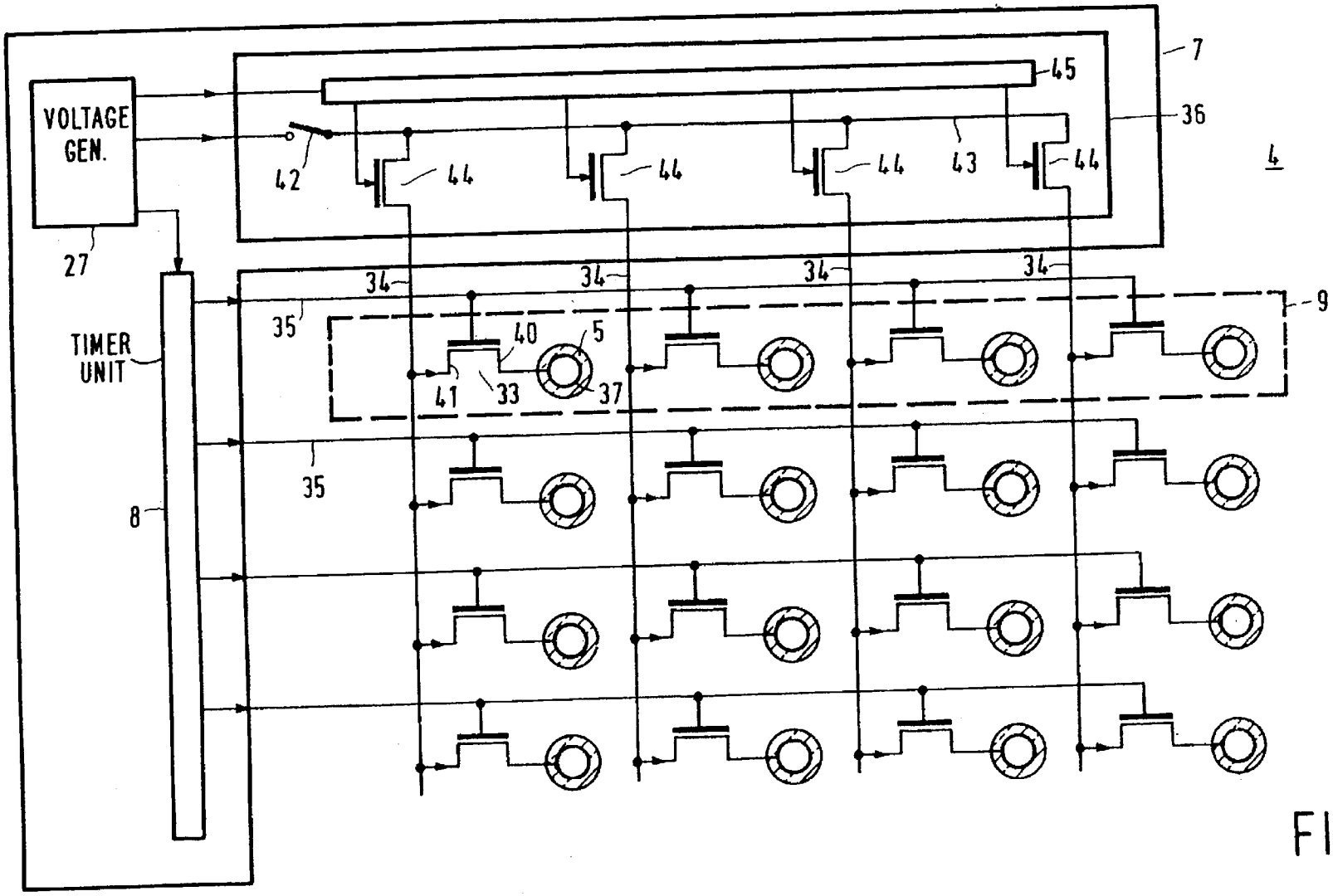
FIG. 3 is a plan view of an X-ray filter of the X-ray examination apparatus shown in FIG. 1.

FIG. 3 is a plan view of an X-ray filter 4 of the X-ray examination apparatus shown in FIG. 1. An X-ray filter 4 comprising 16 capillary tubes in a 4×4 matrix arrangement is shown by way of example; however, in practice the X-ray filter 4 may comprise a much larger number of capillary tubes, for example 200×200 tubes. Each of the capillary tubes is coupled, by way of the electrically conductive layer 37, to the drain contact 40 of a field effect transistor 33 which acts as a switching element and whose source contact 41 is coupled to a voltage line. For each row of capillary tubes there is provided a control line 35 which is coupled to the gate contacts of the field effect transistors in the relevant row in order to control the field effect transistors in this row. The control line 35 of the relevant row is energized by an electric control voltage pulse in order to apply an adjusting voltage to the electrically conductive inner side of the capillary tubes in the row, so that the field effect transistors in the relevant row are electrically turned on during the control voltage pulse. The adjusting unit 7 comprises a voltage generator 27 for applying an electric voltage to the timer unit 8 which applies the control voltage pulses having the desired duration to the individual control lines of the rows of capillary tubes. While the relevant field effect transistors are turned on, i.e. the switching elements are closed, the electric adjusting voltage of the relevant control lines 34 is applied to the capillary tubes. The periods of time during which the electric adjusting voltage is applied to individual capillary tubes in a row can be differentiated by application of the electric adjusting voltage to the respective voltage lines 34 of individual columns for different periods of time. To this end, the adjusting unit 7 comprises a column driver 36 which controls a period during which the electric adjusting voltage generated by the voltage generator 27 is applied to the individual voltage lines. The electric adjusting voltage is applied to a contact 43 via a switch 42. Each of the voltage lines 34 is coupled to a respective switching element, for example a transistor 44, by way of the contact 43. When the transistor 44 of the voltage line 34 is turned on by energizing the gate contact of the relevant transistor by means of a gate voltage, the adjusting voltage is applied to the voltage line. The gate contacts of the transistors 44 are coupled, via a bus 45, to the voltage generator 27 which supplies the gate voltage. The period of time during which the individual voltage lines are energized by the adjusting voltage is controlled by way of the period during which the gate voltages are applied to the gate contacts of the individual transistors 44.

A large effective surface area with adhesion to the X-ray absorbing liquid is realized by providing filter elements with a plurality of capillary tubes. The quantities of X-ray absorbing liquid in capillary tubes of one and the same filter element, which may be coupled to one and the same transistor in their control line, of course, cannot be separately controlled.

Figure 4:
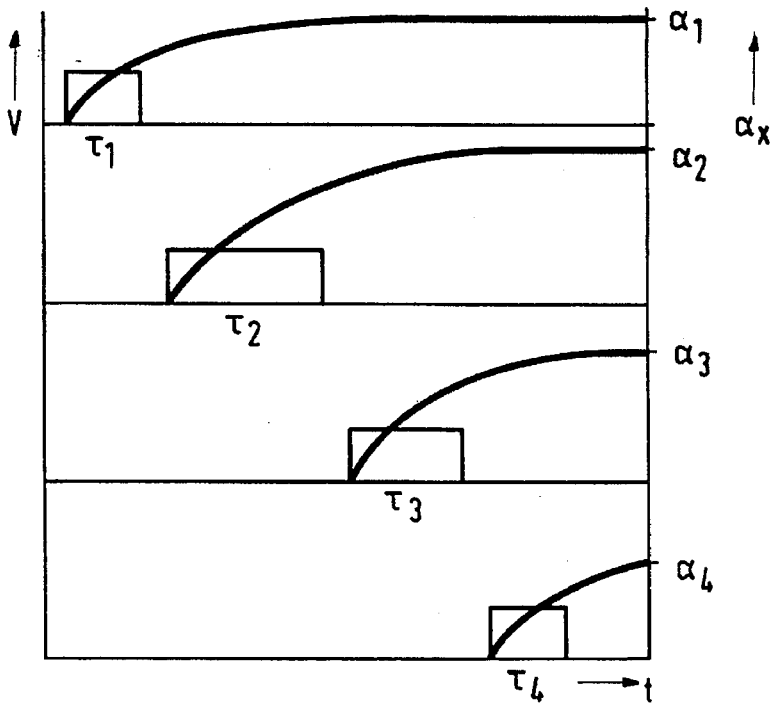
FIGS. 4 and 5 show diagrammatically two different methods of adjusting the X-ray filter, the variation of control voltage pulses applied to the X-ray filter, and the X-ray absorptivities thus adjusted.
Figure 5:
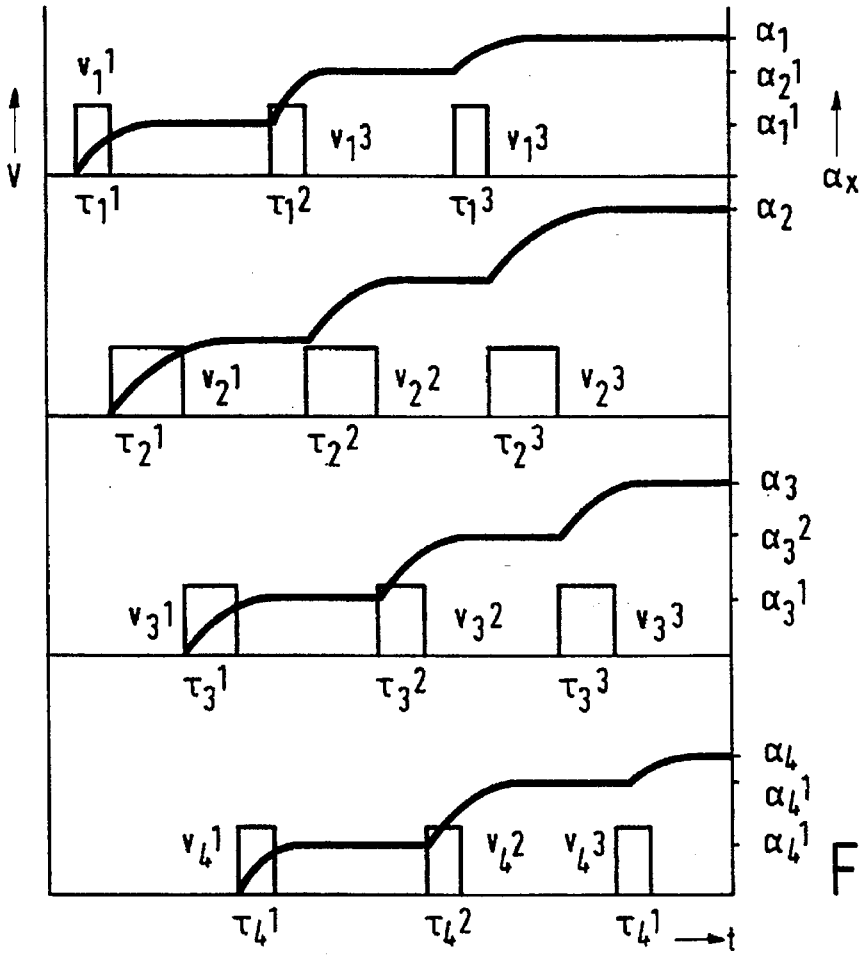

FIGS. 4 and 5 show diagrammatically, for two different ways of adjusting the X-ray Filter 4, the variation of control voltage pulses applied to the X-ray filter 4. As is shown in FIG. 4, first a control voltage pulse $V_1$ of duration $\tau_1$ is applied to the control line of the first row of capillary tubes; subsequently, control voltage pulses $V_2$,$V_3$ and $V_4$ of a duration $\tau_2$, $\tau_3$ and $\tau_4$, respectively, are applied to control lines of the second, the third and the fourth row of capillary tubes, respectively. The capillary tubes in the respective rows are thus successively filled with the X-ray absorbing liquid to a level which is dependent on the period of time during which the relevant voltage line is excited in the period in which a control voltage is supplied. The periods $\tau_i$(i=1, 2, 3 . . . ) amount to approximately one millisecond, so that a few tenths of a second are required to adjust an X-ray filter 4 comprising a few hundred rows of capillary tubes; the adjusting time $t_f$ of the X-ray filter 4 thus mounts to a few tenths of a second.

FIG. 4 also shows the X-ray absorptivity of capillary tubes in the respective rows $\alpha_x$ as a function of time. The X-ray absorptivity is related directly to the relative quantity of liquid in the capillary tubes. When the control voltage pulse $V_1$ is applied to the first row, the capillary tubes become filled with the X-ray absorbing liquid and the X-ray absorptivity increases because the capillary tube is electrically charged. Filling takes place with some delay relative to the control voltage pulse, because some time is required for application of the electric charge (to charge the capacitance) and for the subsequent inflow of the X-ray absorbing liquid. Ultimately, the X-ray absorptivity in the first row reaches the value $\alpha_1$, being the maximum value of the X-ray absorptivity that can be reached in the first row; lower values can be adjusted by applying the adjusting voltage to relevant columns for a period of time which is shorter than the duration of the control voltage pulse. After the voltage pulse $V_1$, the second and subsequent rows receive successive control voltage pulses $V_2$, $V_3$, $V_4$, having durations $\tau_2$, $\tau_3$, $\tau_4$, respectively, so that in the second and subsequent rows maximum X-ray absorptivities $\alpha_2$, $\alpha_3$, $\alpha_4$ can be reached. The X-ray absorptivities of filter elements in the rows are adjusted to different values by way of the period of time during which the voltage lines of the individual columns are energized. Because of the inertia of the inflow of the liquid, the durations of the control voltage pulses in this embodiment cannot be substantially shorter than a few milliseconds; however, the major advantage of this method of adjustment resides in the simplicity of the switching procedure which can be carried out by means of a simple timer unit. Because the adjusting time is shorter than one second, the filter setting, as it is controlled on the basis of the electronic image signal, follows movements in or of the object which have a duration of more than approximately one second. Such movements may be, for example movements of the patient or be caused by respiration, cardiac action or peristaltic movements of the patient.

A particularly advantageous method of adjusting the X-ray filter 4 will be described in detail with reference to FIG. 5. According to this method all rows of the X-ray filter 4 are activated a number of times (n) in succession by control voltage pulses. A setting involving three repeats (n=3) will be described with reference to the Figure. During the first activation first a control voltage pulse $V_1^1$ of duration $\tau_1^1$ is applied to the control line of the first row; furthermore, control voltage pulses $V^1_2$, $V^1_3$, $V_4^1$, having a duration $\tau_2^1$, $\tau_3^1$, $\tau_4^1$, respectively, are applied to the second and subsequent rows. The control voltage pulses are successively applied to the respective rows, so that a control voltage pulse is applied to a row always after termination of a control voltage pulse for the preceding row. During this first activation period capillary tubes in the first and then in the second and subsequent rows become filled with the X-ray absorbing liquid, at least in as far and for as long as the relevant voltage lines carry an adjusting voltage. The periods $\tau_i^j$ amount to approximately one pulse period $t_p=t_f/Nn$, where N denotes the number of rows. $t_p$=25 μs for N=200, n=20 and $t_f$=0.1 s. Subsequently, during a second activation period control voltage pulses $V^2_1$, $V^2_2$, $V^2_3$, $V^2_4$ having durations $\tau^2_1$, $\tau^2_2$, $\tau^2_3$, $\tau^2_4$, are applied to respective rows so that the filling of the capillary tubes continues. Finally, during the third activation period control voltage pulses $V^3_1$, $V^3_2$, $V^3_3$, $V^3_4$, having durations $\tau_1^3$, $\tau_2^3$, $\tau_3^3$, $\tau_4^3$, are applied. Because the control pulses are applied, the capillary tubes are filled with the X-ray absorbing liquid in a phased fashion and the X-ray absorptivity also increases in a phased fashion; the X-ray absorptivity remains approximately constant between the successive control voltage pulses. After termination of the control voltage pulse $V^j_i$, in the $i^{th}$ row an X-ray absorptivity $\alpha_i^j$ is reached and the next control voltage pulse $V_i^{j+1}$ increases the X-ray absorptivity to $\alpha_1^{j+1}$ until ultimately, after the control voltage pulse $V^3_i$, the value $\alpha_i$ is reached. The capillary tubes in the $k^{th}$ row are thus filled with a quantity of X-ray absorbing liquid which is controlled on the basis of the overall duration $t_k=\tau_k^1+\tau_k^2+\tau_k^2+\ldots+\tau_k^n$ of the control voltage pulses applied to the $k^{th}$ row. Because the capillary tubes in different rows are filled partly simultaneously, the adjusting time is reduced and, because the electric charges are delivered in fractions, the durations of the control voltage pulses can be reduced as the number of sampling periods is taken to be larger. A further advantage consists in that more time is available for the filling of the capillary tubes in the rows which are filled last. Furthermore, in comparison with the adjustment of the X-ray filter 4 of FIG. 4, a smaller time difference exists between the filling of the capillary tubes in the first rows and those in the last rows.

The adjustment of the X-ray filter has been explained with reference to the FIGS. 4 and 5 for an X-ray filter comprising only four rows of capillary tubes and involving only three activation repeats by means of control voltage pulses. Evidently, to those skilled in the art it will be obvious that the method in accordance with the invention can be used equally well for an X-ray filter with a large number of rows, for example hundreds of rows, and with a large number of, for example from some tens to some hundreds of repeated activation periods. In FIG. 3 each capillary tube is coupled to a control line via a respective transistor; it is alternatively possible to couple a plurality of capillary tubes together to a control line via one transistor.

In a contemporary X-ray examination apparatus the functions of the adjusting unit can also be executed by a suitably programmed computer or by a microprocessor designed for this purpose.

We claim:

1. An X-ray examination apparatus comprising an X-ray source, an X-ray detector, and an X-ray filter which is arranged between the X-ray source and the X-ray detector, which X-ray filter comprises a plurality of filter elements (5) having an X-ray absorptivity which can be adjusted by controlling a quantity of X-ray absorbing liquid (6) within the individual filter elements, characterized in that the X-ray examination apparatus comprises an adjusting unit for applying an electric voltage to the individual filter elements, which adjusting unit comprises a timer unit for controlling the period of time during which the electric voltage is applied to the filter elements.

2. An X-ray examination apparatus as claimed in claim 1, characterized in that the timer unit is arranged to apply the electric voltage to individual groups of filter elements during a continuous period of said controllable duration.

3. An X-ray examination apparatus as claimed in claim 1, characterized in that the timer unit is arranged to apply the electric voltage alternately to individual groups of filter elements, repeatedly during separate sub-periods.

4. A method of adjusting an X-ray examination apparatus, comprising the adjustment of the X-ray absorptivity of filter elements of an X-ray filter by controlling a quantity of X-ray absorbing liquid within the individual filter elements, characterized in that electric voltages are applied to individual filter elements, and that the quantity of X-ray absorbing liquid within individual filter elements is controlled on the basis of the period of time during which the electric voltage is applied to the individual filter elements.

5. A method as claimed in claim 4, characterized in that the electric voltages are applied to individual groups of filter elements during a continuous period of said duration.

6. A method as claimed in claim 4, characterized in that the electric voltage is applied alternately to individual groups of filter elements, repeatedly during separate sub-periods.

* * * * *